US005742307A

United States Patent [19]

Watrobski et al.

[11] Patent Number: 5,742,307

[45] Date of Patent: Apr. 21, 1998

[54] METHOD FOR ELECTRICAL TAILORING DROP EJECTOR THRESHOLDS OF THERMAL INK JET HEATER ELEMENTS

[75] Inventors: Thomas E. Watrobski, Penfield; William G. Hawkins, Webster; Sophie V. Vandebroek, Penfield, all of N.Y.

[73] Assignee: Xerox Corporation, Stamford, Conn.

[21] Appl. No.: 786,067

[22] Filed: Jan. 21, 1997

Related U.S. Application Data

[63] Continuation of Ser. No. 359,174, Dec. 19, 1994, abandoned.

[51] Int. Cl.[6] ..... B41J 2/05

[52] U.S. Cl. ..... 347/62

[58] Field of Search ..... 347/62, 64, 63

[56] References Cited

U.S. PATENT DOCUMENTS

| | | | |
|---|---|---|---|
| 4,210,996 | 7/1980 | Amemiya et al. | 29/610.1 |
| 4,532,530 | 7/1985 | Hawkins | 347/62 |
| 4,782,202 | 11/1988 | Sawae et al. | 347/191 |
| 4,929,964 | 5/1990 | Sato et al. | 347/62 |
| 4,947,192 | 8/1990 | Hawkins et al. | 346/140 |
| 4,951,063 | 8/1990 | Hawkins et al. | 346/1.1 |
| 4,996,487 | 2/1991 | McSparran et al. | 324/549 |
| 5,162,814 | 11/1992 | Shirakawa et al. | 347/203 |

OTHER PUBLICATIONS

Yoshihito Ameniya et al., "Electrical Trimming of Heavily Doped Polycrystalline Silicon Resistors", 1979, pp. 1738–1742, *IEEE Transactions on Electron Devices*, vol. ED–26, No. 11, Nov. 1979.

*Primary Examiner*—N. Le
*Assistant Examiner*—L. Anderson
*Attorney, Agent, or Firm*—Daniel J. Krieger

[57] ABSTRACT

A method for electrical tailoring of thermal ink jet heater elements. The resistance of ink-jet heater elements formed of polysilicon is changed by applying energy through the resistor element of varying amounts at varying pulse widths. The application of pulsed current for up to 1 second total pulse width at voltages of up to 50 volts decreases the resistance by as much as thirty percent or more of the as fabricated values.

6 Claims, 9 Drawing Sheets

METHOD FOR ELECTRICAL TAILORING DROP EJECTOR THRESHOLDS OF THERMAL INK JET HEATER ELEMENTS

This application is a continuation of Application Ser. No. 08/359,174, filed Dec. 19, 1994, now abandoned.

FIELD OF THE INVENTION

This invention relates generally to adjusting the drop ejector threshold of heater elements in thermal ink jet marking devices after fabrication and more particularly relates to electrical tailoring of heater elements within thermal ink-jet printheads.

BACKGROUND OF THE INVENTION

An ink-jet printer of the type frequently referred to as drop-on-demand, has at least one printhead from which droplets of ink are directed towards a recording medium. Within the printhead, the ink is contained in a plurality of channels. Piezoelectric devices or thermal energy pulses cause the droplets of ink to be expelled as required, from orifices or nozzles located at the end of the channels. In thermal ink-jet printing, thermal energy pulses or power pulses are usually applied to resistors, also known as heaters, each located in a respective one of the channels. The heaters are individually addressable to heat and vaporize the ink in the channels. As a voltage is applied across a selected heater, the temperature of the directly adjacent ink layer is elevated to the vicinity of 300° C. The ink is almost always water based and as the water is converted into steam by the process of film boiling, a vapor bubble grows in that particular channel and ink bulges from the channel nozzle. It is important to point out that the temperature of the heater element's surface greatly exceeds the normal boiling point of water because the temperature rise is so rapid that the boiling takes place close to the triple point of water. As will be subsequently discussed in further detail, the resistive heater itself is separated from the ink by a composite of a cavitation layer and an insulator layer, and the top surface of the cavitation layer which is in contact with the ink must reach 300° C. in order for bubble nucleation to occur. The 300° C. temperature of the cavitation layer necessarily means that the heater itself gets to a substantially higher temperature such as 350° to 400° C. A direct consequence of the high temperature of bubble nucleation is that the steam generated is at a pressure of many atmospheres; typically 50. After the bubble has grown for about 15 usec, the bubble begins to collapse. The ink within the channel then retracts and separates from the bulging ink thereby forming a droplet moving in a direction away from the channel nozzle and towards the recording medium where upon hitting the recording medium a spot is formed. The channel is then refilled, for example, by capillary action which, in turn, draws ink from a supply container of liquid ink. Operation of a thermal ink-jet printer is described in, for example, U.S. Pat. No. 4,849,774.

The ink-jet printhead may be incorporated into either a carriage-type printer, a page-width type printer, or any other printing product. The carriage type printer typically has a relatively small printhead containing the ink channels and nozzles. The printhead is usually connected to a disposable ink supply cartridge and the combined printhead and cartridge assembly is attached to a carriage which is reciprocated to print one swath of information (equal to the length of a column of nozzles) at a time on a stationary recording medium, such as paper or a transparency. After the swath is printed, the paper is stepped a distance equal to the height of a printed swath or a portion thereof, so that the next printed swath is overlapping or contiguous therewith. The procedure is repeated until the entire page is printed. In contrast, the page-width printer includes at least one stationary printhead having a length equal to or greater than the width of the paper. The paper is continually moved past the page-width printhead in a direction substantially normal to the printhead length and at a constant speed during the printing process. To effect color printing, four bars are typically present.

In many designs of ink-jet printers currently available, an essential portion of the printhead, particularly the portion of the printhead having the heaters formed thereon, is formed by semiconductor manufacturing techniques using a silicon substrate. This modified silicon substrate is generally known as the heater die or heater chip, and can include not only the individual heaters or heating elements formed thereon but also driver transistors, each one connected to a corresponding heater, and electronic circuitry for controlling the selective actuation of each of the individual heaters. One manufacturing approach for thermal ink jet printheads employs construction of the heating elements in the form of a deposit of polycrystalline silicon which may be doped with arsenic, boron, phosphorus or other known dopants. Other manufacturing approaches employ heater materials which are deposited by sputtering resistive films. The two most common are $HfB_2$ and Ta/Al alloys. The high operating temperature of the heater element necessarily requires careful attention to be paid to the heater material because it must withstand repeated high temperature cycling without changing resistance.

In a common method of manufacture of thermal ink-jet printhead dies, each die is sized to accommodate 128 or more nozzles spaced at a density of 300 nozzles per inch or greater. In mass production of such dies, as many as 200 or more dies may be formed on a single silicon wafer, the entire wafer being manufactured in a number of steps and then subsequently cut or diced into the dies themselves. The combination of the heater die and associated fluid handling component is frequently referred to an an ink jet module. The ink jet module is then packaged into a printhead with other components. The ink jet module is really the ink jet analog of an integrated circuit chip and it's relationship to a circuit board.

Commercially acceptable printheads must consistently perform from one ink jet module to the next. In the case of scanning carriage style printers, it is essential that the power supply which powers the ink jet printhead(s) be the same voltage for all printers and for all printheads, and not require adjustment each time a new head is used. This cost requirement and convenience can only be achieved when the printheads have heaters with a narrow distribution of resistance from head to head. The need for tight manufacturing tolerance of heater elements is especially true when a number of individual die are assembled together to form a partial width array or page-width printhead. A pagewidth printhead will contain over 10 individual die to complete one full width bar.

The ability to closely control heater element resistance is technically important for several reasons related to print quality and durability of the printhead. Once a printhead is completed, it is experimentally found that the printhead has a threshold voltage for ejection of drops. The procedure for determining this threshold is discussed subsequently. It is very important to be able to make printheads which have precisely controlled threshold voltages. If the threshold voltage is too high, the printhead will not operate or the drops will be erratic. If the threshold voltage of the printhead is too low, the printhead will have shortened lifetime both because the operational lifetime of the heater elements under ink degrade rapidly with excessive heating and because many ink formulations "kogate" or burn on to the heater if the temperature is too high. If is also found that the heater element's resistance variation is the main source of drop ejector threshold variation for a given heater element design in production.

One necessary performance characteristic is the uniformity of spot size. All of the nozzles in a printhead must eject drops of ink forming spots on the recording sheet having uniform size under given operating conditions such as power to the individual heaters and the temperature of the liquid ink. Of equal importance is resultant spot size uniformity among various printhead dies. Various manufacturing conditions may cause variations from one die to the next which may be small in absolute terms but which have a significant effect on printed spot-size uniformity. Minute variations in, for example, the dimensions of the channels forming the nozzles, or in the resistivity of the polysilicon forming the heating elements, may have a substantial effect on the printed spot size associated with a particular die.

To obtain high quality thermal ink-jet printing, the resistance of individual heaters must be well controlled, not only from one heater to the next but also from one die to the next or from one page width bar to the next page width bar as in color printing. Although heater elements are fabricated using a thin polysilicon layer that is treated at high temperatures to obtain uniform films, it is still difficult to obtain a uniformity of within plus or minus 5 percent over a large number of individual dies or a large number of wafers. Uniformity of heater resistance within an individual die is typically, however, very high. It is therefore desirable that a thermal ink-jet printer include printheads and/or page width printbars which have a consistent uniformity of resistance for the individual heaters displaced along a linear array of nozzles.

U.S. Pat. No. 4,947,192 to Hawkins et al. describes a monolithic silicon integrated circuit chip for a thermal ink-jet printer. The integrated circuit chips are formed by MOS technology, are thermally stable and can be operated at high voltages.

U.S. Pat. No. 4,951,063 to Hawkins et al. describes heating elements for thermal ink-jet devices. A thermal ink-jet printhead is improved by a specific heating element structure and method of manufacture.

U.S. Pat. No. 4,996,487 to McSparran et at. describes an apparatus for detecting the failure of thermal heaters in ink-jet printers. A test circuit coupled to the resistive heater elements and operable by a control circuit generates a failure signal representative of a resistance above a preselected value.

"Electrical Trimming of Heavily Doped Polycrystalline Silicon Resistors", Y. Amemiya et al, IEEE Transactions On Electron Devices, ED 26, (November 1979) p 1738 describes a procedure to adjust the resistance of polysilicon resistor elements for the purpose of adjusting analog circuit elements to precise tolerances after manufacture. The procedure employs application of a high current to permanently change the resistance of the polysilicon resistor as a final step in manufacture. This reference discusses the use of the procedure for trimming analog circuit resistor networks, especially for A to D converters.

SUMMARY OF THE INVENTION

In accordance with one aspect of the present invention, there is provided a method of adjusting the drop ejector threshold of a heater element in an ink jet heater die. The method includes the steps of fabricating the heater element comprising a resistor having a resistance, determining the resistance of the heater element, comparing the determined resistance with a target resistance range, and applying a resistance adjustment condition to the resistor until the resistance of the heater element is permanently changed to be within the target resistance range.

While the present invention will be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

DETAILED DESCRIPTION OF THE INVENTION

Figure 11:
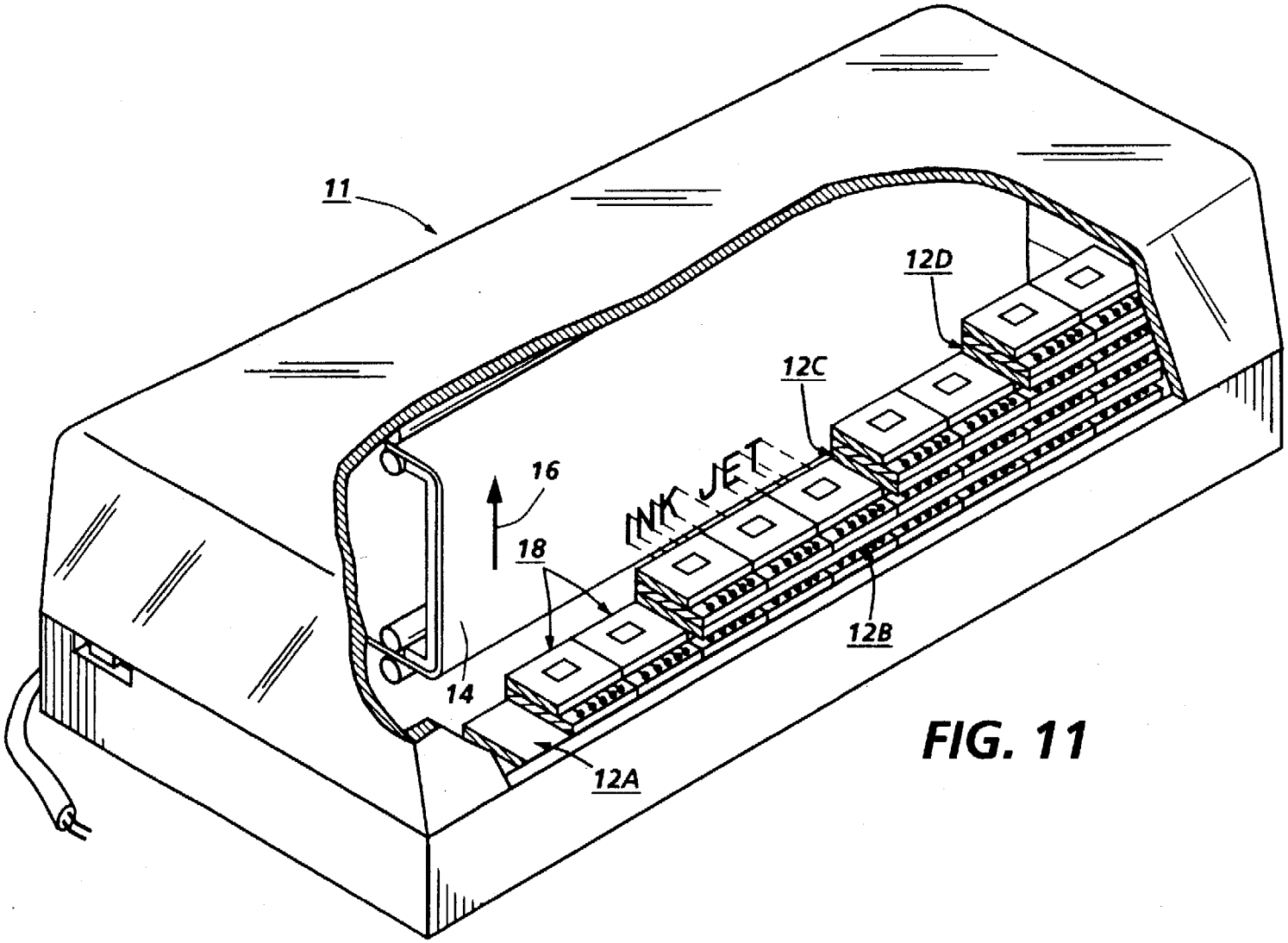
FIG. 11 is a fragmentary perspective view of a multi color page-width type thermal ink-jet printer having four-page width printbars.

FIG. 11 is a fragmentary perspective view of a page-width type, multi-color, thermal ink-jet printer 11. In general, a page-width monochrome printer has a single stationary printbar, such as 12A, having a length equal to or greater than the width of a recording medium, such as a sheet of paper 14. A multi-color page width printer has four stationary printbars 12A, 12B, 12C and 12D stacked one above the other, with the nozzles of each printbar aligned with respect to one another. The recording medium or sheet of paper 14 is continually moved past the pagewidth printbars in the direction of arrow 16, a direction normal to the printbar length and at a constant speed during the printing process. Refer to U.S. Pat. No. 4,463,359 to Ayata et al. and 4,829,324 to Drake et al. for examples of page-width printing.

The page-width printbars 12 are made of an array of individual printhead subunits 18. Any known method may be used to fabricate the individual printhead subunits 18. One example, for instance, is U.S. Pat. No. Re. 32,572 to Hawkins et al., incorporated herein by reference. In general, printhead subunits are derived from a heater die containing an array of resistors and associated electronic circuitry and a channel die containing arrays of recesses used as sets of channels ending in nozzles and having associated reservoirs for carrying ink into the channels. Each of the printhead subunits 18 formed of an individual heater die and channel die are aligned along the width of a page and attached to a substrate to form the page-width printbar. It should also be noted that one of the individual printhead subunits 18 may be incorporated into a printhead cartridge attached to a scanning carriage for use in a scanning type thermal ink-jet printer.

Figure 1:
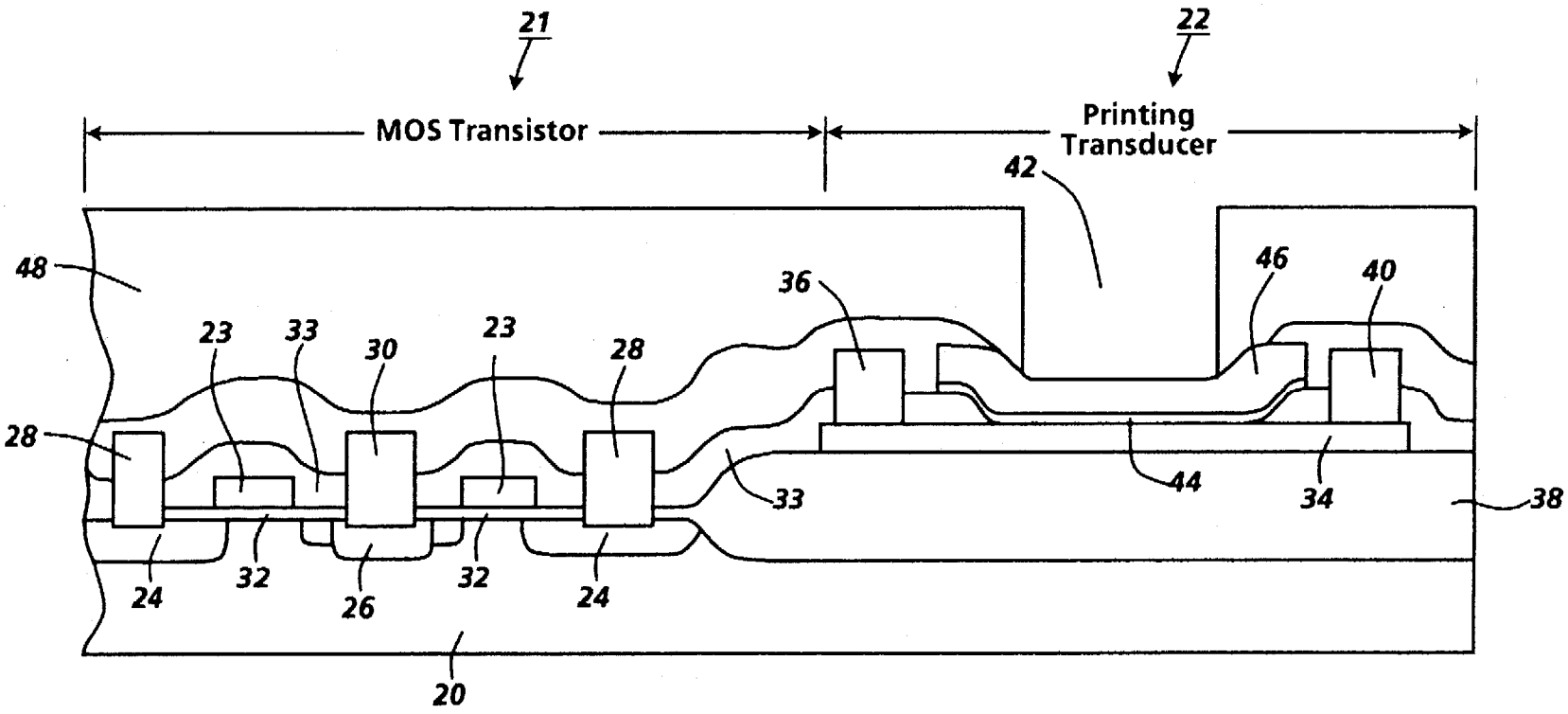
FIG. 1 is a schematic side view of one embodiment of a portion of a heater die illustrating a driver transistor connected to a printing transducer.

FIG. 1 illustrates a side elevational view of one embodiment of a printing transducer and driver transistor formed on a silicon substrate 20 according to known semiconductor manufacturing techniques. Silicon is a crystalline solid having a periodic arrangement of atoms formed in a lattice structure. This lattice structure is then doped with any number of impurities which alter the crystalline structure and consequently the conductivity of the semiconductor. To complete a device, other layers and regions are thermally grown or formed by the deposition of materials (oxide, polysilicon, nitride, aluminum, etc.) on top of the silicon substrate 20, doping of the materials, and known photolithographic techniques.

As illustrated in FIG. 1, a MOS transistor 21 is monolithically integrated on the same silicon substrate 20 as a printing transducer 22. The MOS transistor 21 includes a polysilicon gate region 23, a source region 24, and a drain region 26. An aluminum contact 28 is coupled to the source region 24 and a second aluminum contact 30 is coupled to the drain region 26. A gate oxide layer 32 separates the gate 23 from the source and drain regions 24 and 26, respectively, and from the silicon substrate 20. A reflow glass region 33 is placed above the gate oxide layer 32 and the gate region 23 to thereby insulate the gate region 23 from the aluminum contacts 28 and 30.

A resistor 34 is connected to the MOS transistor 21 by an aluminum contact 36 connected to the aluminum contact 30 to the drain region 26. The resistor 34 is formed by depositing a layer of polysilicon which is then patterned and doped with an impurity, such as phosphorus, arsenic, or boron. The resistor 34 is separated from the substrate 20 by a field oxide layer 38 which thermally isolates the resistor 34 from the substrate 20. An aluminum contact 40 provides a connecting point to a second end of the resistor 34 for connection to a voltage supply. Layer 44 is an insulator layer which electrically isolates the heater element from the ink. The preferred material for this layer is pyrolitically deposited silicon nitride. The high temperature deposition conditions associated with this silicon nitride layer insure that it will be stable under subsequent circuit processing conditions and during ink jet heater element operation. Layer 46 is a final cavitation layer, preferably fabricated from tantalum. The tantalum layer protects the insulator and heater from the cavitational forces during bubble creation and especially during bubble collapse. It is very important that the electrical and thermal properties of layers 44 and 46 are not degraded by the heater element adjustment procedure discussed here.

One set of processing conditions known to achieve stable heater elements for thermal ink jet printing include the steps of depositing 450 nm of polysilicon by LPCVD at 612° C., doping the polysilicon to 40 ohms/sq (final) sheet resistance with phosphorus, thermally oxidizing the doped polysilicon to 100 nm oxide thickness in dry oxygen at 1000° C., and then applying 7.5 wt % PSG reflow glass to the heater and reflowing the glass for about 1 hour at 1000° C. in flowing oxygen and then an anneal in nitrogen. The combination of high phosphorus doping level, relatively long dry oxidation following doping, and reflow cycles all contribute to polycrystalline silicon grain growth in the heater elements and render the completed elements stable. The heater elements are fabricated on a field oxide layer which is about 1.30 um thick, thereby providing thermal resistance between the conductive silicon substrate and the heater for the short 3 usec heating pulse duration employed in actual operation, and also enabling the heater element to be thermally isolated from the substrate for the purposes of adjusting heater element resistance. The protection layers for the heater elements are formed by depositing 100 nm of silicon nitride at about 800° C. and then immediately depositing tantalum by sputter deposition. The experiments described here use heater elements having a normal operating temperature of 300° to 375° fabricated with these process conditions. It is expected that other processing conditions could be established to achieve similarly stable heater elements under normal operating conditions with the ability to adjust resistance by overstressing, but that there are a number of process sequences that would not produce heater elements having electrical properties which would be stable enough to serve as heater elements for thermal ink jet printing due to the high temperature of operation.

In operation of this embodiment, a polysilicon resistor 34 heats a supply of ink located in a pit 42 located above the resistor 34 and separated therefrom by an insulating layer 44 and a tantalum layer 46. The tantalum layer 46 provides protection for the polysilicon resistor 34 from the degrading effects of ink and bubble collapse located in the pit 42. A polyimide layer 48 covers the MOS transistor 21 and a portion of the resistor 34 to thereby form the pit 42 which operates in conjunction with a channel die (not shown). U.S. Pat. No. 4,947,192 to Hawkins et al. describes a monolithic silicon integrated circuit chip for a thermal ink-jet printer, the relevant portions of which are incorporated herein by reference.

Figure 2:
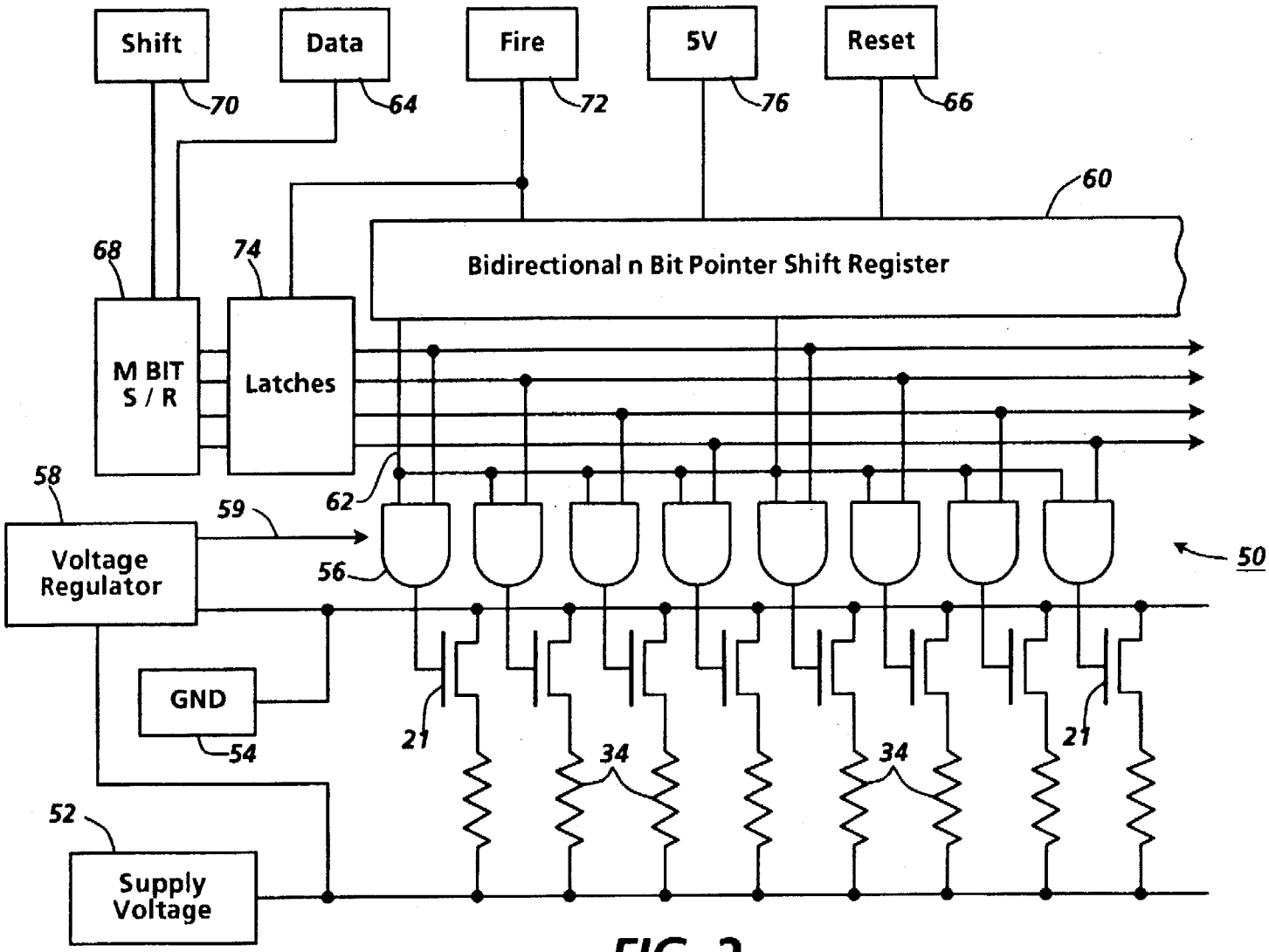
FIG. 2 is a circuit diagram illustrating one embodiment of a thermal ink-jet integrated circuit.

FIG. 2 illustrates a circuit diagram of one embodiment of a heater die 50 of a thermal ink-jet printhead including the power switches which are power MOS transistors 21 and the resistors 34. The basic circuit elements of a thermal ink-jet printhead integrated circuit necessary to selectively expel ink from the array of linearly aligned nozzles are illustrated. The heater die 50 includes a plurality of the resistors 34 typically powered by a forty volt supply coupled to a voltage supply line 52. Each of the individual resistors 34 is additionally coupled to the power MOS FET drivers 21 having the source thereof coupled to a ground 54. The power MOS FET drivers 21 energize the resistors 34 for expelling ink from the nozzles. Although a thermal ink-jet chip 50 can include many resistors 34, eight resistors 34 are shown in FIG. 2 for illustrative purposes.

Control of each of the drivers 21 is accomplished by an AND gate 56 having the output thereof coupled to the gate of the driver 21. A voltage regulator 58 regulates the supply voltage 52 to a voltage of typically 13 volts for supply to the AND gates 56 through a line 59. This operating voltage for the AND gates 56 enables the drivers 21 to be turned on harder through the application of a higher gate voltage than would be available from a 5 volt power supply.

To reduce the amount of external leads and bonding pads necessary to individually energize or fire each of the resistors 34 in the illustrated embodiment, the integrated circuit on heater die 50 controls a plurality of resistors 34 simultaneously by using a bi-directional N bit pointer shift register 60. The shift register 60 controls four of the AND gates 56 at a time. Printing is initiated with a single one bit pointer which begins at the left most side of the bi-directional N bit pointer shift register 60 at a conductor 62. The pointer starts on the left-hand side and propagates to the right-hand side or in the alternative starts on the right-hand side and propagates to the left-hand side depending on the state of a data line 64 at the time a reset line 66 goes high. The length of the shift register 60 depends on the number of resistors 34 in the heater die 50 and the number of bits in an M-bit shift register 68.

After the shift register 60 is reset by the reset line 66, M bits of data are loaded from the data line 64 into the M-bit shift register 68. The shift register 68 is shifted by a shift line 70 which receives shift information from a printhead controller as is understood by one skilled in the art. The M bits of data, which have been loaded into the M-bit shift register 68, control whether or not a resistor 34 within a block of resistors selectively controlled by the shift register 60 will be energized according to the four data bits located in the M-bit shift register 68. (Although a 4-bit shift register is depicted in FIG. 2, it is conceivable that other combinations of bits can be activated.) A fire control pulse received from the printhead controller at a fire line 72 controls the amount of time that the individual heaters are energized. These pulses are currently on the order of 3 microseconds. During the cycle of the fire control pulse received over the fire line 72, four new bits of information are loaded into the M-bit shift register 68. The completion of the fire cycle advances the shift register 60 one position and the fire cycle begins again. A latch 74 is used to latch the information from the M-bit shift register 68 onto each of the individual and gates 56, the output thereof being coupled to the gate of the drivers 21. A 5-volt supply 76 supplies power to the shift register 60.

Figure 3:
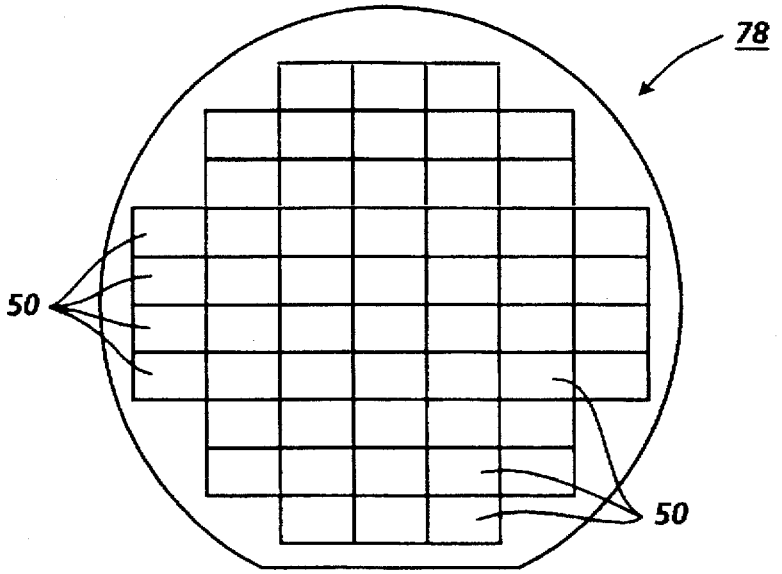
FIG. 3 is a schematic plan view of a silicon wafer having individual heater dies.

FIG. 3 illustrates a plan view of a silicon wafer 78 having formed thereon a plurality of the heater dies 50. Each of the heater dies 50 includes the electronic circuitry necessary to select and fire each of the individual resistors 34 located thereon as previously described. Each of the heater dies 50 also includes the appropriate connecting pads for connecting the various supply voltages and control signals as in one embodiment described with reference to FIG. 2. Consequently, it is possible to test each of the individual heater dies 50 for proper operation thereof before any of the heater dies 50 are joined to a respective channel die to form a printhead subunit. Each of the individual heater dies 50 is tested by appropriate test circuitry which selectively activates each of the resistors 34 on each of the individual heater dies 50. The test apparatus cycles through each of the resistors 34 by supplying a supply voltage of approximately forty volts to the supply voltage line 52 and selectively firing each of the resistors 34 through the fire line 72 according to a data signal (either a 0 or a 1) supplied through the data line 64. The fire line 72 receives a pulse signal of voltage wherein the pulse width controls the amount of energy applied to the resistors 34.

In the course of this investigation, polysilicon layer thickness, annealing temperature, and doping concentration were all examined as sources of heater element resistance variation. It was discovered that the primary source of heater element variation is variations of doping in the polysilicon layer together with a superlinear relationship between doping level and polysilicon resistivity. Heater element doping is achieved by high current ion implantation, and while ion implantation is locally uniform within a given area on a wafer, it is very difficult to achieve the identical dose of implantation across an entire wafer and across different lots. This experimentation was run in a batch implantation system, where the entire lot was run together. This study shows why it is reasonable to expect that the resistance uniformity within a single die is very high but that the absolute resistance value varies with lot number and location on the wafer. It is relatively easy to achieve a resistance control of ±15% (3 sigma), but very difficult to achieve resistance control of less than ±5%. The ±5% uniformity goal is necessary for good ink jet module performance and long lifetime.

During testing, the amount of current drawn by each of the individual resistors 34 is measured to not only determine the functionality of the circuit being tested but also to determine the resistance value of each of the individual resistors 34. For proper operation of the thermal ink-jet printhead, the individual heaters within a die and within a page-width printhead are currently tested to be ±5 percent from a mean value of a predetermined resistance. In a present embodiment, polysilicon resistors are 140 ohms having an approximate fabricated length of 120 microns, a width of 60 microns, and a thickness of 500 nanometers. It is possible that approximately 75 percent of the individual heater dies 50 can fail during testing due to non-uniformity of the resistance of one or more of the individual resistors 34 within a die depending on defined uniformity limits. It is typically found that the heater elements are very uniform except for defective die sites, but that the value of the resistance varies by 10 to 15%. The resistance can be determined from the actual heater elements or from a test patch of polysilicon in proximity to the heaters.

While current test results illustrate that uniformity of individual ink jet module resistances can be a problem, it is quite possible that future generations of advanced small feature size complementary metal oxide semiconductor (CMOS) compatible resistive heaters will be even more likely to have resistance uniformity problems than now encountered. This may be due to the fact that the dopant atoms may not all be activated or that the polysilicon will have a smaller grain size resulting from the required reduction in thermal cycling during the manufacturing process. Consequently, a more accurate, quicker and controllable method of providing uniform resistance in individual heaters is desirable. Therefore, the present invention includes a method which provides a repeatable, controlled change in the resistance of thermal ink-jet polysilicon heaters, by as much as thirty percent of the as fabricated values. The decrease in resistance is accomplished by applying a resistance adjustment condition or electrically overheating out of specification heater resistors to permanently force a controllable resistance change. Such a procedure allows for electrical tailoring of individual heater resistances to values up to and greater than a thirty percent reduction of the original resistance depending on the amount of energy applied through the individual heater according to applied energy, for example, burn voltage, pulse width, and total pulse time.

Figure 4:
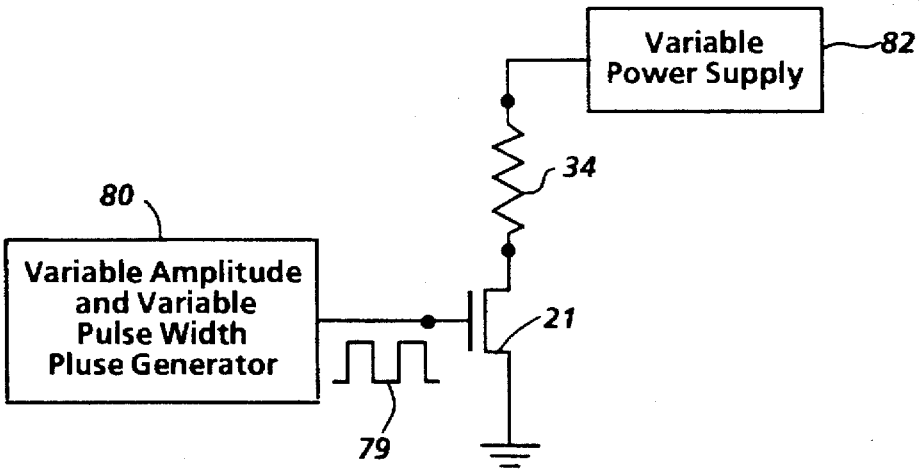
FIG. 4 is a simplified schematic diagram showing one embodiment of the circuitry for changing the resistance of individual heater elements.

FIG. 4 illustrates a simplified schematic of the present invention for adjusting the resistance of the resistor 34 in the described ink jet printhead through the application of the resistance adjustment condition in the form of constant or varying current signals and/or voltage signals such as DC, AC, or pulsed voltages or currents. In the current embodiment, a voltage pulse signal 79 is applied to the gate of the driver 21. It has been found that by electrically stressing the resistor 34 through applying voltage pulses provided by a variable amplitude and a variable pulse width pulse signal generator 80, the polysilicon heater resistance can be electrically tailored or adjusted after the individual resistors 34 have been fabricated on the wafer 50. Short pulses, on the order of twenty microseconds per fire pulse, are sufficient to change resistance and greatly increase the resistance uniformity across the entire wafer. Since the adjustment time is comparable to the test time, tester productivity is not severely compromised. In operation, a variable power supply 82 is coupled to one side of the resistor 34.

Figure 8:
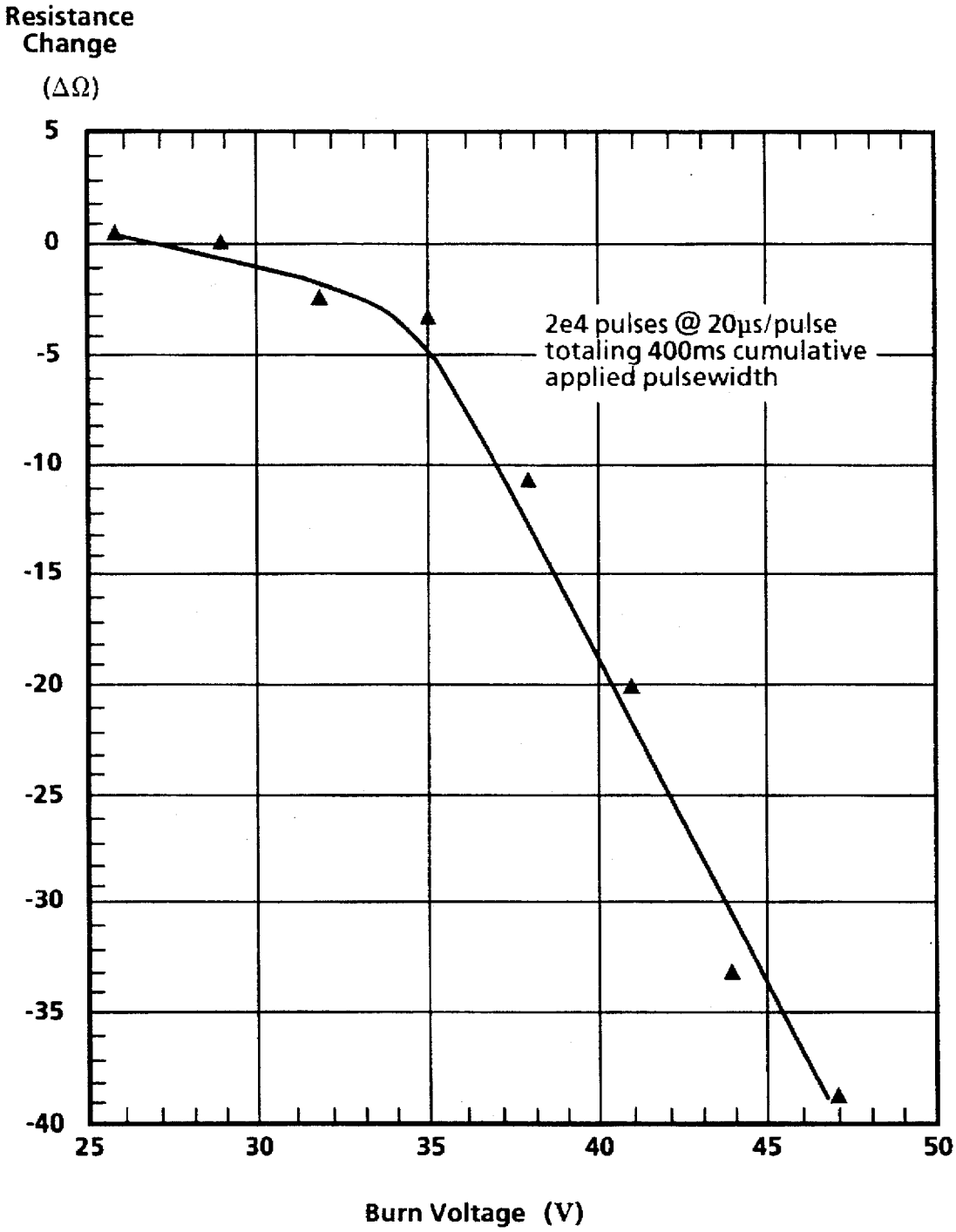
FIG. 8 is a graph illustrating heater element resistance variation as a function of voltage applied across the series combination of the heater element and the power transistor.

The result presented here shows that the observed effect is a consequence of heating the polysilicon heater elements to a higher temperature, such as a temperature above 400° C., and not a consequence of higher current levels alone. Heater element adjustment can also be achieved through application of higher current pulses. An important point to be made about FIG. 8 is that even though relatively long 20 usec pulse is applied rather than the normal 3 usec thermal ink jet printhead operating condition pulse (so that the data in FIG. 8 is a severe stress case), the resistance of the heater element does not change until the voltage is at 35 volts. This shows that the heater element has stable resistance value under a range of operating conditions and only begins to change after a threshold is reached. Consequently, any pulsing conditions to change resistance must be longer than the pulsing condition applied during normal operation. As long as the heater element operates away from the threshold level during normal operation, and the temperature required to effect resistance change is not damaging to the passivation layers above the heater element (tantalum layer oxidation, polyimide degradation, insulator layer changes, etc.), the method can be successfully employed.

A second important point to be made about the thermal ink jet application is that the drop ejector has a threshold voltage which is accurately adjusted by the correction scheme just outlined. The threshold voltage for drop ejection is defined as the operating voltage at which the drop ejector just begins to emit stable drops. This voltage level can be determined to within a few hundred millivolts by observing the transit time of drops as a function of voltage applied to the printhead. It is found that no drops are ejected and then there is a transition region where the drop speed increases rapidly with voltage and then stabilizes. This onset of drop velocity stabilization is defined as the drop ejector's threshold voltage. The measurement of resistance of heater elements at the end of printhead fabrications is really a surrogate for measurement of the drop ejector threshold, because drop ejector threshold is the parameter that needs to be carefully controlled from printhead to printhead.

The threshold voltage of a completed drop ejector depends on two factors; the resistance of the heater element and the thermal resistance of the layers between the heater element and the ink surface. If the thermal resistance of the insulator and passivation layers changes as a consequence of overheating the heater element, then the measured resistance of the heater element after the adjustment would not be comparable to the resistance prior to adjustment and this technique would be of limited utility. It has been found, however, that the drop ejector threshold voltage depends only on heater element resistance and not on any other factors, which demonstrates that the layers between the heater element itself and the ink are not effected by the adjustment scheme. The stability of the insulator layer and tantalum layer is partly a consequence of the silicon nitride insulator layer. This layer is known to have a low hydrogen content in comparison to other types of silicon nitride such as plasma nitride as well as many low temperature deposited and sputtered insulators. The relative electrical and thermal stability of the pyrolytic nitride insulator layer is of importance in the stability of the heater element.

If testing and correction is being done at the die level, the variable power supply 82 would be connected to the supply voltage line 52 as illustrated in FIG. 2. Typically, a variable power supply supplying a burn voltage ranging from twenty-six volts to forty-seven volts is sufficient. The pulse signal generator 80 is used to drive the gate of the driver 21. If testing and correction is being done at the printhead subunit level, the pulse generator 80 is connected to the fire line 72.

Figure 5:
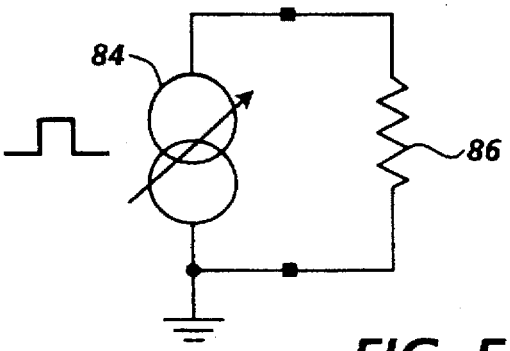
FIG. 5 is a simplified schematic diagram sharing a second embodiment of the circuitry for changing the resistance of a polycrystalline resistor.

As illustrated in FIG. 5, it is also possible to connect a pulse signal generator 84 supplying the appropriate energy, such as voltage and current signals, directly across a resistive element 86 instead of across the series combination of the resistor 34 and driver 21, as illustrated by the embodiment of the ink jet printhead. This situation might occur for any embodiment where a polysilicon resistor is used or where driver transistors are not on the same chip as the resistors. To adjust these resistors, the pulse signal generator 84 would include the appropriate switching devices for applying a variable amplitude and variable pulse width signal to the resistor.

Additionally, since the tantalum layer 46 may become oxidized at the temperatures resulting from the electrical overheating, the wafers could be tested and adjusted in a "glove box" filled with argon gas, or other inert gases, having a load lock to enable loading and unloading of a plurality of wafers at a time. Testing and correction can also be done at the printhead element level or at the printhead cartridge level.

During normal operation of a thermal ink-jet printhead in a thermal ink-jet printer, the individual resistors 34 are typically pulsed for a period of three microseconds at forty volts. These pulsing conditions, however, have been shown to be insufficient to effect any significant resistance changes. By increasing the length of the pulse widths and by varying the values of the burn voltages under extended pulsing times, for instance, up to a cumulative pulse time of one second per heater, it has been found that resistance values can be decreased by up to thirty percent. The present invention may be extended to changing the resistive values not only of polysilicon resistors but other polycrystalline resistors including those made of nichrome, amorphous silicon, polysilicon, and germanium.

Figure 6:
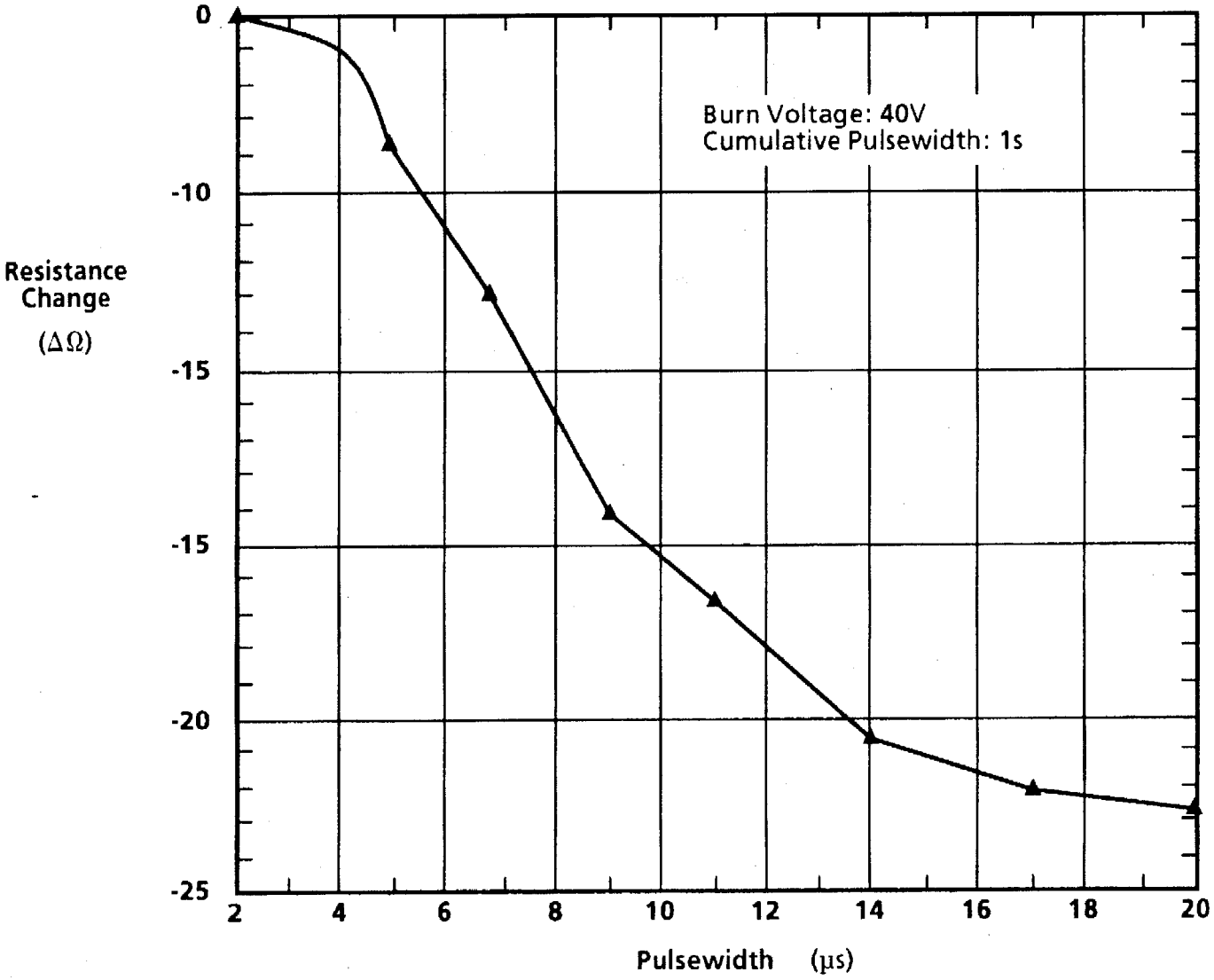
FIG. 6 is a graph illustrating the heater resistance variation as a function of the pulse width of a plurality of repeatedly applied pulse currents through the heater element.

FIG. 6 illustrates a graph showing heater resistance variation as a function of the pulse width of a plurality or repeatedly applied pulsed current signals applied by the pulse generator 80. As shown in FIG. 6, the change in resistance can be reduced from zero to approximately twenty-three ohms by adjusting the variable power supply 82 to forty volts and by operating the pulse generator 80 to provide a cumulative pulse width of one second. For instance, a negative two ohm change in resistance is made by firing three microsecond pulses for a total period of pulse widths equaling one second. A negative twenty-three ohm change in resistance can be made by firing twenty microsecond pulses having a cumulative pulse width of one second.

Figure 7:
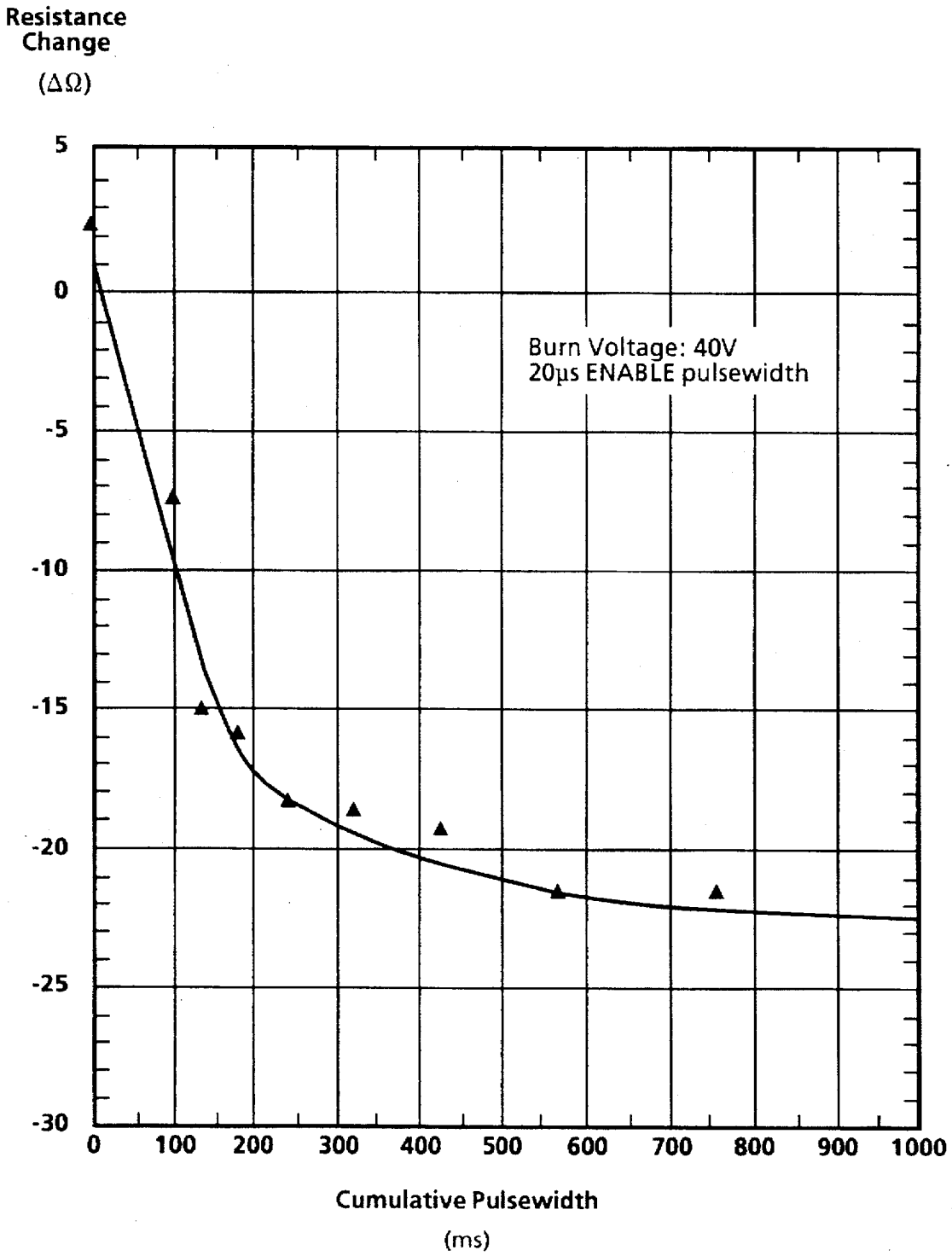
FIG. 7 is a graph illustrating heater resistance variation as a function of the cumulative pulse time of a plurality of pulsed current through the heater element.

FIG. 7 illustrates heater resistance variation as a function of cumulative pulse time of a plurality of 20 microsecond pulsed currents through the heater element. At a supply voltage of forty volts and repeatedly applying a current signal having a twenty microsecond pulse width, heater resistance can be changed from zero ohms to a negative twenty-three ohms when the repeated twenty microsecond enabled pulse widths have a cumulative pulse time of one second.

FIG. 8 illustrates a graph of heater resistance variation as a function of applied voltage across the series combination of the heater element and the power transistor. This graph was generated by applying a signal having $2\times10^4$ pulses at twenty microseconds per pulse and totaling a cumulative pulse time of 400 milliseconds over a burn voltage range of from twenty-five volts to forty-seven volts. As can be seen in the graph, the change in resistance varies from zero ohms to a decrease of approximately thirty-nine ohms.

Figure 9:
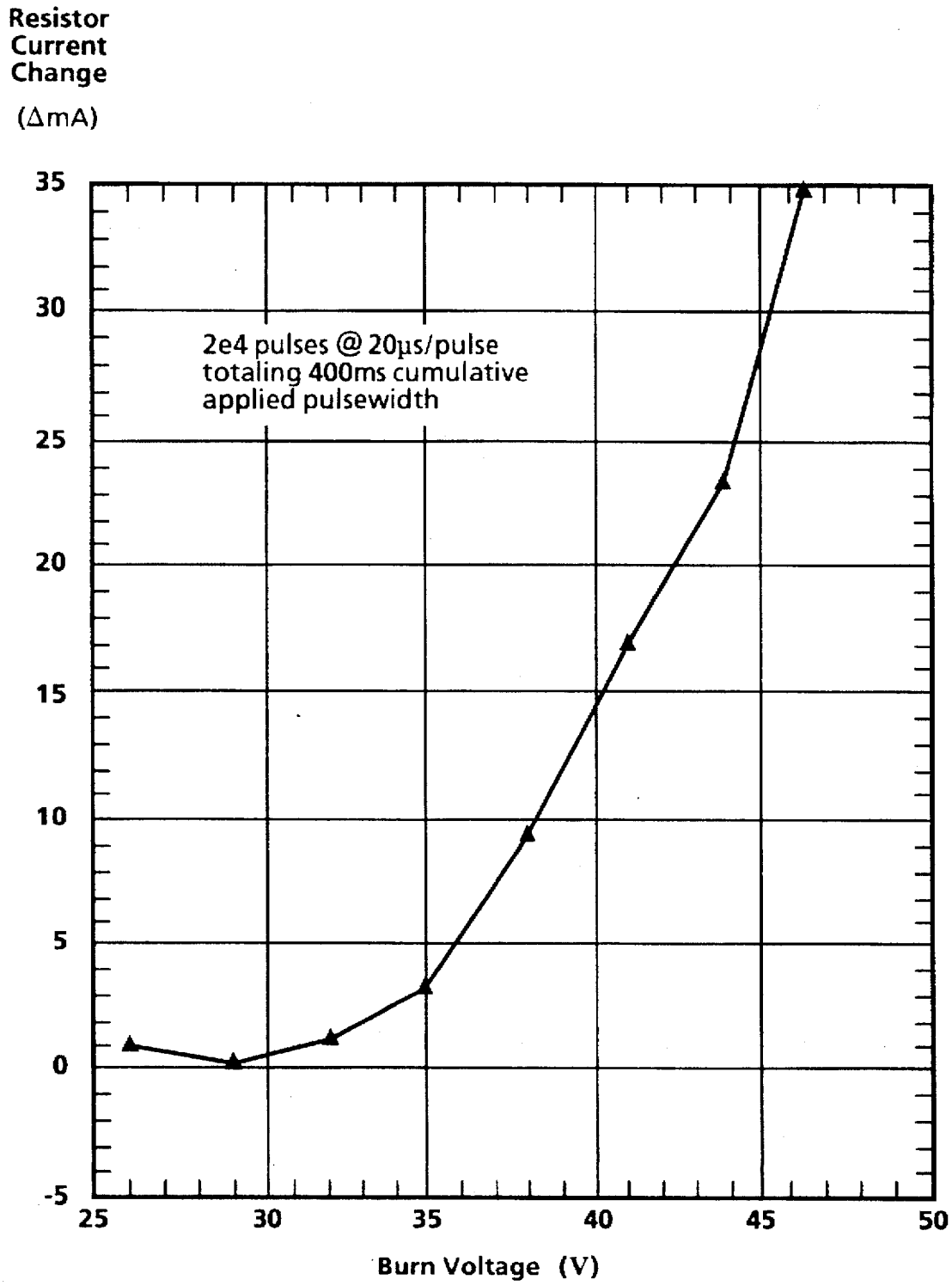
FIG. 9 is a graph illustrating the average heater element current versus voltage applied across the series combination of the heater element and the power transistor.

FIG. 9 illustrates an analogous curve to the one illustrated in FIG. 7 of average heater element current versus voltage applied across the series combination of the heater element and the power transistor. This graph was generated by applying a signal having $2\times10^4$ pulses at twenty microseconds per pulse totaling a 400 millisecond cumulative applied pulse width. This graph provided an equation for creating one embodiment of an automated programming algorithm, as follows:

$$V_{burn}=(((I_{target}-I_{original})-3.6)/2.2)+35.0\text{ V.}$$

This algorithm allows for the application of a selected burn voltage which is valid for the linear part of the curve (approximately 3.6 milliamps to 24 milliamps and 35 volts to 43 volts). Based on this graph a thirty-five to forty-three volt burn voltage range has been selected as sufficiently broad to correct any heater resistance out of specification in a sample population as well as for its approximate linearity.

Figure 10:
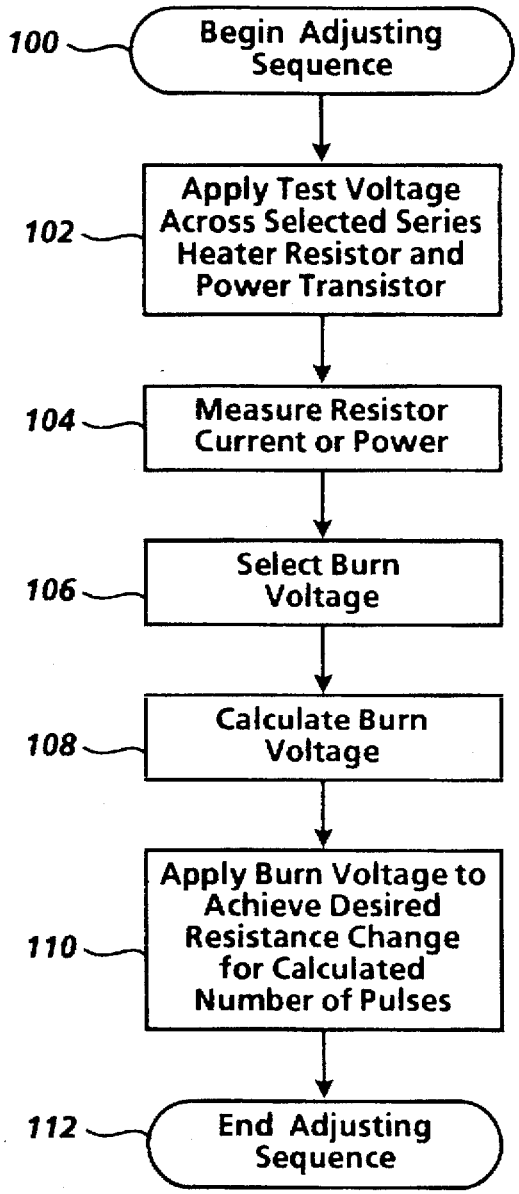
FIG. 10 is a flow diagram illustrating one embodiment of a procedure for adjusting the resistance of a heater element.

FIG. 10 illustrates a flow chart of the steps used to adjust the resistance of a single resistor using the above equation in one embodiment of an automated programming algorithm. At step 100, the adjusting sequence begins by selecting a heater resistor to be adjusted. At step 102, a test voltage is applied across the selected resistor and power transistor in series. The average value of the current or power through the resistor is determined at step 104. The measured applied current is $I_{original}$ in the above equation. Once the applied current is known, a burn voltage is selected at step 106 based on the known parameters of the heater resistors being adjusted and the desired target current or power. In the present embodiment, for instance, having a nominal resistance of 140 ohms, it is known that a burn voltage of between approximately thirty-five and forty-three volts can be applied. Once a target current or power, is selected, a burn voltage is calculated using a derived equation, such as the one previously described, at step 108. Once calculated, burn voltage is applied to achieve desired current or power to make the desired resistance change at step 110. Once step 110 is complete, the adjusting sequence is complete at step 112. After adjustments, the heater resistance can be measured again to determine if the value of resistance is within the desired range. The above procedure can be repeated to make further adjustments.

Consequently, there has been provided a method for adjusting the resistance of polysilicon heaters in an ink-jet die. It is, therefore, apparent that there has been provided in accordance with the present invention, a method that-fully satisfies the aims and advantages hereinbefore set forth. While this invention has been described in conjunction with a specific embodiment thereof, it is evident that many alternatives, modifications, and variations will be apparent to those skilled in the art. In addition, the present method does not need to be performed at the die level but can be performed at any level of fabrication, including after the completion of a printhead. For instance, if the printhead heaters change over a period of time from operation in a printer, the heaters could be trimmed in the printer itself. Likewise, the experimental results illustrated in FIGS. 6–9 depend on the particular resistor geometry, doping, concentration, and fabrication methods. Consequently, other applied amounts of energy (voltages, currents, power, pulse width) which may be different for other resistors, fall within the scope of the present invention. Accordingly, the invention is intended to embrace all such alternatives, modifications and variations that fall within the spirit and broad scope of the appended claims.

What is claimed is:

1. A thermal ink jet drop ejector, for ejecting an ink drop, generating thermal energy in response to an operating condition pulse, having a operating condition pulsewidth, being applied thereto during normal operation of the drop ejector, comprising:

a silicon substrate;

a field oxide layer, deposited on said silicon substrate;

a polysilicon resistor, formed on said field oxide layer, said polysilicon resistor including a doped polysilicon material having a resistance value, the resistance value determined by adjustment with the application of a current pulse, generated by a signal generator, applied thereto, the current pulse, including a pulsewidth being equal to or greater than the operating condition pulsewidth, being applied repeatedly to said polysilicon resistor; and an insulator layer deposited on said polysilicon resistor.

2. The thermal ink jet drop ejector of claim 1, wherein said polysilicon resistor includes a polysilicon material having a resistance value being determined by adjustment with the creation of a temperature above approximately 400° C. therein with the current pulse generated by the signal generator.

3. The thermal ink jet drop ejector of claim 2, wherein said insulator layer comprises a silicon nitride layer deposited on said polysilicon resistor and a cavitation layer formed on said silicon nitride layer.

4. The thermal ink jet drop ejector of claim 3, wherein said silicon nitride layer comprises a pyrolitically deposited silicon nitride.

5. The thermal ink jet drop ejector of claim 4, wherein said cavitation layer comprises tantalum.

6. The thermal ink jet drop ejector of claim 1, wherein said polysilicon resistor comprises a doped polysilicon material having the resistance determined by the current pulse being applied repeatedly to said polysilicon resistor for a total time period of one second or less.

* * * * *